US006033485A

United States Patent [19]

Didier et al.

[11] Patent Number: 6,033,485

[45] Date of Patent: Mar. 7, 2000

[54] PROCESS FOR THE PICKLING OF METALLIC MATERIALS

[75] Inventors: Paul Didier, Gueugnon; Bernard Vialatte, Le Creusot, both of France

[73] Assignee: Usinor, Puteaux, France

[21] Appl. No.: 08/727,630

[22] PCT Filed: Jun. 7, 1995

[86] PCT No.: PCT/FR95/00744

§ 371 Date: Jan. 7, 1997

§ 102(e) Date: Jan. 7, 1997

[87] PCT Pub. No.: WO95/34695

PCT Pub. Date: Dec. 21, 1995

[30] Foreign Application Priority Data

Jun. 15, 1994 [FR] France ..... 94 07 328

[51] Int. Cl.[7] ..... C23G 1/02

[52] U.S. Cl. ..... 134/3; 134/2; 134/4; 134/6; 134/10; 134/11; 134/19; 134/26; 134/28; 134/41

[58] Field of Search ..... 134/2, 3, 4, 6, 134/10, 11, 19, 26, 28, 41

[56] References Cited

U.S. PATENT DOCUMENTS 4,097,271 6/1978 Swinkels et al. ..... 75/104

*Primary Examiner*—Ardin H. Marschel

*Attorney, Agent, or Firm*—Oblon, Spivak, McClelland, Maier & Neustadt, P.C.

[57] ABSTRACT

Method in which the pickling solution is sprayed onto the metal part in a confined atmosphere with an oxygen supply by feeding into the spraying enclosure an oxygen-containing gas, the pickling solution being recycled in a closed pickling solution circuit. The device for pickling metal surfaces comprises a spraying enclosure (1) with a collecting tank (2), means for spraying (6) a pickling solution (S) in said enclosure, means (11) for recirculating said solution between said tank (2) and said spraying means (6) and means (8,9) for passing an oxygen-containing gas through said enclosure, and optionally means (13) for maintaining the temperature of said solution, and control means. The method of the invention is designed to improve the productivity of lines for pickling stainless or alloy steel components while economising on reagents.

13 Claims, 3 Drawing Sheets

PROCESS FOR THE PICKLING OF METALLIC MATERIALS

The present invention relates to a process for the acid pickling of metallic materials, especially ones made of alloy steel, stainless steel or titanium alloys.

According to a process which is known, especially from FR-A-2,587,369, the pickling of steel materials is performed in a bath consisting of an aqueous solution containing ferric ions and hydrofluoric acid. This bath has the advantage of not containing nitric acid and therefore of not generating toxic compounds derived from nitric acid during pickling.

As a substitute for hydrofluoric acid, which may be dangerous to handle, it has been proposed in FR-A-2,657,888 to use organic acids which are not iron-oxidizing agents, especially formic acid or acetic acid.

Other inorganic acids, such as sulphuric acid or phosphoric acid, may also be used in making up such pickling baths.

It is known to carry out the pickling of the surfaces of metal components by immersing the components in baths of the aforementioned type. During pickling, the baths may be regenerated by introducing an oxidizing agent so as to increase their life. To do this, air or an oxygen-containing gas is bubbled into the bath, or else a more powerful oxidizing agent than gaseous oxygen, such as ozone, hydrogen peroxide or a compound of the peroxide, peracid or persalt type, may be introduced.

However, especially in the case of the continuous pickling of strip, the pickling of wire or the pickling of components, the pickling kinetics may be too slow and require the plant to be expensively tied up for an excessive period of time.

In order to increase the pickling kinetics appreciably, it is known to apply the pickling solution by spraying it onto the surface of the said metal component: thus, the solution in contact with the surface to be pickled is continuously being replenished, while at the same time the pickling residues are being removed very rapidly.

According to a conventional process, the pickling solution is sprayed onto the component to be pickled and the solution, after it has come into contact with the component, is recovered and recycled in a closed pickling-solution circuit. The solution is usually regenerated by bubbling air or an oxygen-containing gas in at one point in the pickling-solution recirculation circuit.

In industrial pickling processes, these operations are undertaken in a closed spray chamber in which the components to be pickled lie. Under these confined-atmosphere pickling conditions, it has been observed that, although the pickling rate with the said sprayed solution was initially much higher than that in immersion pickling, this improvement disappeared after a few hours and could not be maintained throughout the life of the said solution, this being so despite the regeneration of the solution by bubbling air or oxygen in.

The efficacy of the process thus rapidly returns to being comparable with, or even inferior to, that of an immersion process.

The object of the invention is to provide a process for the-acid pickling of metal components using spraying, in which process the pickling rate is significantly improved throughout the period of use of the same solution.

In order to maintain the pickling rate with the said sprayed solution at a high level, it is possible to add a powerful oxidizing agent, especially hydrogen peroxide, to the pickling solution.

However, such oxidizing agents, especially hydrogen peroxide, have the drawback of being expensive.

The object of the invention is also to improve, in a particularly economical way, the pickling rate in processes of the aforementioned type.

To this end, the subject of the invention is a process for the pickling of metallic materials, especially ones made of alloy steel, stainless steel or titanium alloys, using a pickling solution S containing ferric ions in acid medium comprising at least one acid chosen from a haloacid, especially hydrofluoric acid, an inorganic acid, especially sulphuric acid or phosphoric acid, and organic acids which are not iron-oxidizing agents, especially formic acid or acetic acid, in which process the said solution is sprayed onto the material, recovered and recycled in a closed pickling-solution circuit and the said spraying is carried out in a confined atmosphere in a spray chamber with an influx of oxygen by introducing an oxygen-containing gas G into the said chamber.

The pickling process of the invention may also be applied to zirconium-based, cobalt-based or nickel-based alloys or to carbon steels.

The materials to be pickled may be in the form of strip, wire, tube, plate or any metal component.

Introducing an oxygen-containing gas into the confined atmosphere makes it possible to maintain, throughout the pickling operation, a high pickling rate. The oxygen contained in the said gas may be introduced, even partially, in the form of ozone.

This influx of oxygen may advantageously be performed continuously, by sustaining the flow of an oxygen-containing gas G in the spray chamber, and very advantageously by uniformly distributing the continuous flow of the said gas in the chamber in order to ensure that the composition of the atmosphere in the chamber is homogeneous.

Preferably, the oxygen content of the said oxygen-containing gas G is greater than 10%. The gas may, for example, be air.

Advantageously, the flow rate of the said oxygen-containing gas G is at least equal to the spray flow rate of the said solution S.

Preferably, the flow rate of the said gas G makes it possible to replenish the atmosphere in the spray chamber on average at least every fifteen minutes, and preferably every five minutes.

It is also advantageous for the influx of oxygen to enable an oxygen content of the atmosphere in the spray chamber at least equal to 10% to be maintained.

Moreover, the ratio between the spray flow rate of the said solution S onto the metallic surface, expressed in liters/minute, and the surface area to be pickled per unit time, expressed in square meters per minute, is preferably at least equal to five.

In general, it is preferable for the pickling solution to be sprayed in the form of small droplets which provide a large surface area for exchange between the sprayed liquid and the atmosphere prevailing in the spray chamber. The size of the droplets depends on the flow rates of the liquid and especially of the gas in the said chamber and advantageously lies within the range corresponding to atomization processes.

Preferably, in the process of the invention, at least part of the pickling solution is introduced into the said chamber by atomization.

The pickling process may be a batch process, the spraying of the components to be pickled taking place in a closed chamber equipped with oxygen introduction means.

However, it is generally preferred to operate continuously in a chamber through which the components to be pickled may run, but which creates a confined atmosphere around the said components. This chamber may, for example, be a spray tunnel. The chamber is also equipped with oxygen introduction means.

In an advantageous embodiment of the invention, a pickling solution S is used which contains hydrofluoric acid and $Fe^{3}$+ions, present in the form of fluorine complexes, the concentration of ferric ions $Fe^{3+}$ being between 1 and 150 grams per liter, and which has a pH between 0 and 3; it also contains $Fe^{2+}$ ions and its redox potential measured with respect to a saturated calomel reference electrode is between −200 mV and +800 mV; such a pickling solution is especially described in European Patent Application No. 0,188,975 filed by the Applicant.

Surprisingly, without adding a powerful oxidizing agent to the pickling solution during use, especially hydrogen peroxide, even after many hours of using the same solution, by recirculating it in a closed circuit, and of spraying the said solution onto components to be pickled in the said confined atmosphere, for example in a tunnel, this confined atmosphere being replenished by virtue of the introduction of an oxygen-containing gas, the pickling rate remains lastingly much higher than the pickling rate which would have been obtained by immersion of the said components in the said solution and oxidant regeneration by bubbling oxygen into the said solution.

During pickling, the consumption and ageing of the pickling solution may be monitored by measuring the redox potential and the pH of the solution in the recirculation circuit.

Thus, the pickling process may be operated by monitoring the redox potential of the solution. It will be possible to maintain the value of the potential at a predetermined value by adjusting the flow rate of gas G introduced, by adding an oxidizing agent to the solution S in the recirculation circuit or by adjusting the spray flow rate of the solution S.

Monitoring the redox potential of the pickling solution proves to be particularly advantageous within the context of the present invention since it makes it possible to use the recycled pickling solution for a very long period of time with good pickling efficacy, while extending the time between interruptions for maintenance of the equipment.

The present inventors have been able to determine that it is possible to carry out spray pickling using a solution having a redox potential which is sufficiently high, to ensure good pickling efficacy, but sufficiently low to limit the precipitation and crystallization of ferric compounds and thus reduce the risk of clogging in the plant, especially at the spraying elements.

In particular, measuring the redox potential of the pickling solution makes it possible, by comparing it with the initial value of the potential of the solution at the start of pickling, to assess the ageing of the said solution and to detect any anomalies. Thus, although one of the aims of the invention is to avoid having to use powerful, but expensive, oxidizing agents, it may be necessary, depending on the value of the redox potential, to have a strong oxidation means which temporarily and/or locally supplements the action of the oxygen carrier gas introduced into the spray chamber in order quickly to return to an advantageous redox potential allowing good pickling.

Furthermore, the process according to the invention may be used for pickling with solutions containing ferric ions in acid media comprising acids other than hydrofluoric acid, especially organic acids, used in closed circuit and therefore requiring regeneration by means of an oxidizing agent, for example by means of an oxygen-containing gas or hydrogen peroxide, this regeneration being controlled by measuring the redox potential of the solution.

It has been possible to show that, in the case in which the redox potential is maintained by adding a powerful booster oxidizing agent, especially hydrogen peroxide, to the pickling solution, the process of the invention remains economical compared with an immersion process in which the same regulation of the redox potential is carried out. This is because, for the same efficacy, a smaller quantity of booster oxidizing agent is used in the spraying process of the invention.

Advantageously, the pickling solution is maintained within a predetermined temperature range, preferably at a constant temperature to within operating variations, in the closed solution-recirculation circuit.

Advantageously, a heating and/or reheating operation is carried out at some arbitrary point in the recirculation circuit, using any suitable technique. Preferably, a stream of hot oxygen-containing gas, advantageously a stream of hot air, is made to flow into the solution so as simultaneously to reheat and to regenerate the pickling solution. In the recirculation circuit, reheating takes place preferably just prior to the spraying of the solution.

The process according to the invention applies to continuous pickling, especially the pickling of metal strip, and to batch pickling, especially pickling of coils of wire or of metal components.

The subject of the invention is also a device for pickling the surfaces of metal components by spraying, which implements a process as described hereinabove. This device comprises:

- a spray chamber provided with a collecting tank;
- means for spraying a pickling solution in the said chamber;
- means for recirculating the said solution between the collecting tank and the spraying means;
- and means for ventilating the said chamber using an oxygen-containing gas.

The device according to the invention may include one or more of the following characteristics:

- the said ventilating means deliver the said oxygen-containing gas at a minimum flow rate representing the volume of the said chamber replenished at least every fifteen minutes, and preferably every five minutes;
- the said means for spraying the said pickling solution are of the pneumatic atomization type;
- the said means for spraying the said pickling solution comprise conventional means of the sprinkling type and means of the pneumatic atomization type.

The device according to the invention may furthermore comprise means for maintaining the temperature of the said solution, possibly providing heating or cooling.

Pickling processes usually employ solutions at a temperature above room temperature, these solutions tending to cool down during use. The temperature maintenance means are therefore preferably means for reheating the pickling solution.

Reheating means may comprise a conventional vessel reheating by conduction or alternatively means for blowing a hot oxygen-containing gas, especially hot air, into the solution, these two types of means possibly being combined. They are preferably arranged just upstream of the spraying means.

Advantageously, the device may furthermore comprise liquid/solid separation means, especially settling means, in order to strip the pickling solution flowing in closed circuit of the solid particles arising from pickling which are entrained with the solution to the collecting tank. In this embodiment, the said separation means may be provided with means for blowing a hot oxygen-containing gas into the region where the liquid resides.

The device may advantageously comprise monitoring means comprising at least one measurement probe, especially one for measuring the temperature, the pH or the redox potential of the solution, these means being installed at any point in the pickling-solution recirculation circuit.

These monitoring means may comprise, in particular, a probe for measuring the redox potential of the pickling solution.

In the latter case, the device may furthermore comprise means for injecting an oxidizing agent, especially hydrogen peroxide, into the circuit for recirculating the said solution, these means being slaved to the said probe for measuring the potential.

Moreover, the said ventilating means may be equipped with a valve for regulating the gas flow rate, this valve being slaved to the said probe for measuring the potential.

Likewise, the said spraying means may be equipped with a valve for regulating the flow rate of the solution, this valve being slaved to the said probe for measuring the potential.

Illustrative embodiments of the invention will now be described with regard to the appended drawings, in which:

Figure 1:
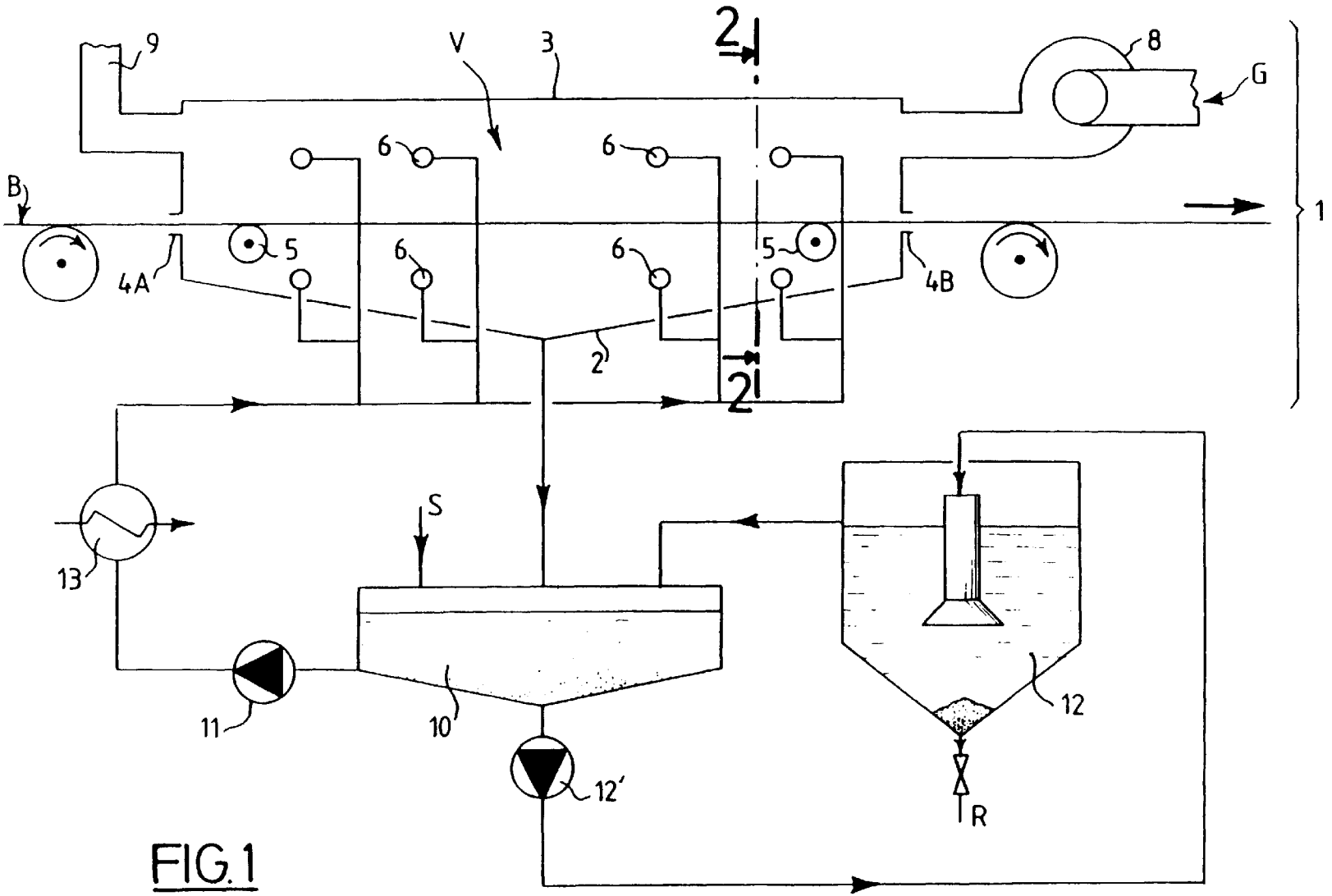
FIG. 1 is a diagrammatic view of a device for the continuous pickling of metal strip using spraying according to the invention.

The device depicted in FIG. 1 comprises a spray chamber, means for spraying a pickling solution in the said chamber, means for ventilating the said chamber, means for controlling, means for recirculating, means for treating and means for maintaining the temperature of the said solution.

The said spray chamber comprises a tunnel 1 equipped with a collecting tank 2, a cover 3, an inlet lock 4A and an outlet lock 4B for the strip to be pickled, and means for transferring the said strip, these being composed of rollers 5 which define a strip path or pickling plane P.

As is conventional, the spraying means comprise spray bars 6 which are parallel to the rollers 5, regularly spaced apart and arranged above and below the said pickling plane P, as depicted in detail in FIG. 2; the spray bars 6 are rigid tubular pipes which terminate in a multitude of spray nozzles 7 arranged uniformly along the spray bar 6.

The said spray nozzles 7 are of a type known per se, intended to produce a flat jet.

The distance separating the orifices of the nozzles 7 in the pickling plane P in the direction of the jet is between 5 cm and 70 cm, and preferably equal to approximately 30 cm.

Figure 2:
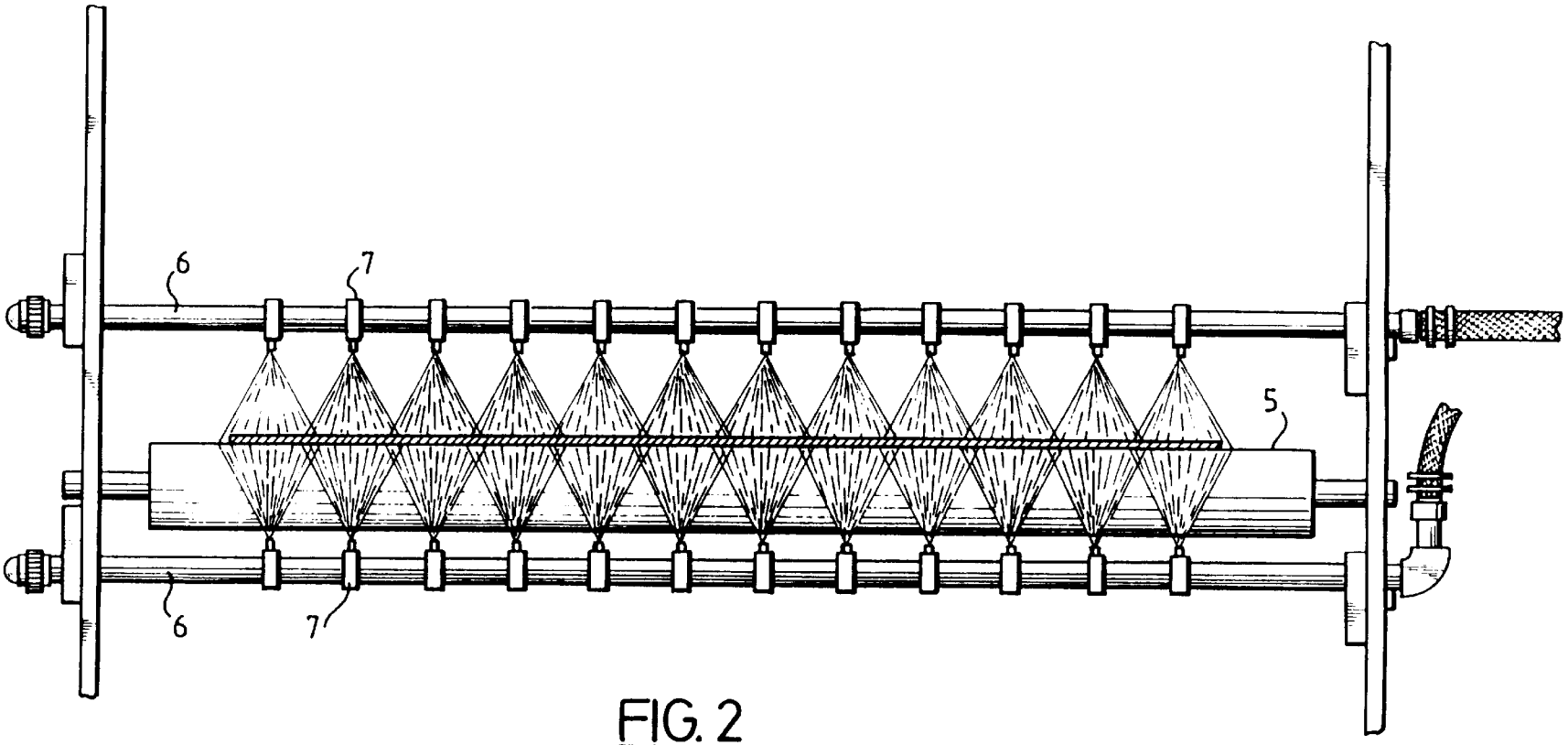
FIG. 2 is a sectional view of the device in FIG. 1, depicting two spray bars of the pickling device according to the invention.

The nozzles 7 of the same stray bar 6 are oriented so as to create flat jets which extend over the width of the strip path and the distance between the nozzles 7 is less than the width of the jet in the region of the pickling plane P in such a way that the flat jets of each nozzle of the same spray bar partially overlap over the entire width of the strip path, as depicted in FIG. 2.

In general, the ventilating means comprise a circuit for supplying gas to the chamber and a circuit for extracting gas from the chamber. These circuits are preferably designed, in a manner known per se, to ensure that the atmosphere in the chamber has a homogeneous composition.

In the device in FIG. 1, the means for ventilating the tunnel comprise a ventilator 8 connected to one end of the tunnel by a gas supply pipe and a gas extraction flue 9 located at the other end of the tunnel.

The inlet of the ventilator 8 is connected to an air intake port, not depicted, and the ventilator is equipped with a valve, not depicted, for regulating the flow rate; the flue 9 is connected to a gas treatment device, not depicted, which allows recovery of some of the extracted mist or droplets from the gas flux.

The said recirculation means comprise a buffer tank 10 connected to the collecting tank 2 and a pump 11 for reinjecting, under pressure, the solution from the buffer tank 10 to each of the spray bars 6.

The pump 11 has characteristics which make it possible to feed the said spray bars at a pressure of between $0.5\times10^5$ and $7\times10^5$ Pa, and preferably a pressure equal to $3\times10^5$ Pa; the pump 11 is equipped with a valve, not depicted, for regulating the flow rate.

The buffer tank 10 is equipped with a feed inlet, especially for topping up with pickling solution S.

The said control means consist of a probe for measuring the redox potential, this probe, not depicted, being installed in the region of the buffer tank 10.

Without departing from the invention, the said probe for measuring the redox potential may be installed at other points in the pickling-solution recirculation circuit.

The said treatment means comprise a settling tank 12.

The settling tank 12 is installed in a secondary recirculation circuit connected to the buffer tank 10, the flow rate of which is set by a pump 12'; the settling tank 12, known per se and not described in detail here, is equipped with a means for extracting the solid residues R.

The said means for maintaining the temperature comprise a heater 13 which is installed in the pipe connecting the pump 11 to the spray bars 6; the heater 13, known per se, is not described in detail here.

A description will now be given of the implementation of the pickling process according to the invention using the device described hereinabove.

The process according to the invention is used here to pickle a stainless steel strip B of width Lb.

The buffer tank 10 is filled with a pickling solution S containing ferric ions in hydrofluoric acid medium.

The means for spraying, recirculating, treating and heating the pickling solution are switched on, as are the means for ventilating the spray tunnel 1.

The strip B is made to pass continuously through the spray tunnel 1 on the rollers 5 at a run speed Vb, in succession through the inlet lock 4A and then the outlet lock 4B.

Using the valve for setting the pump 11, it is possible to regulate the spray flow rate of the pickling solution in such a way that, expressed in liters per minute, it is at least equal to five times the surface area to be pickled, here (Vb×Lb), expressed in $m^2$/minute.

With the total volume of the spray tunnel being V, in $m^3$, the flow rate of- air forced by the said ventilator 8 into the said tunnel is set, using the valve for regulating the flow rate of the ventilator 8, to V/15 $m^3$/minute, in such a way that the atmosphere in the said tunnel is on average replenished at least every fifteen minutes, and preferably every five minutes.

Passing through the spray tunnel 1, and in particular between the spray bars 6, the strip B is sprayed uniformly on both its sides by the pickling solution S sprayed by the nozzles 7 of the spray bars 6.

The spent solution, comprising solid pickling residues in suspension, pours under gravity into the collecting tank 2 then into the buffer tank 10.

The probe for measuring the redox potential makes it possible to measure the redox potential of the solution S in the buffer tank 10.

The solid residues in the solution S are separated by means of the settling tank 12 when the said solution passes into the secondary recirculation circuit connected to the buffer tank 10.

The solution S, stripped of the solid residues in suspension, is reinjected by the pump 11 to the spray bars 6 and the spray nozzles 7, the solution being heated by the heater 13.

The heater 13 allows the temperature of the solution to be advantageously maintained between 15 and 80° C., and preferably between 40 and 70° C.

As the strip B is running progressively through the spray tunnel 1, the solution S is continuously sprayed onto the said strip in a constantly oxygen-replenished atmosphere and recirculates in closed circuit in the pickling device.

In order to compensate for consumption of the pickling solution S and to maintain the pH within a predetermined range of values, it is possible to add acid or fresh solution directly to the buffer tank via its feed inlet or at other suitable points in the plant.

Without departing from the process according to the invention, it is possible to maintain the value of the redox potential measured by the probe at a predetermined constant value by adjusting the air flow rate of the Ventilator 8 or by adding to the buffer tank 10 a booster oxidizing agent more powerful than air, for example a peroxide, a persalt or ozone, or by adjusting the spray flow rate.

According to one variant of the device of the invention, the spray nozzles 7 are replaced by pneumatic atomization nozzles fed, as previously, with liquid by the pump 11 and fed with pressurized gas by an air compressor or an oxygen-containing-gas compressor.

The pneumatic atomization nozzles are known per se and are not described here; the characteristics of the pump 11 are tailored to the liquid-feed specifications of the said nozzles.

Thus, for implementing the process, the solution S is advantageously sprayed, by atomization, onto both sides of the strip to be pickled and the atmosphere in the pickling tunnel is advantageously replenished at the spray means themselves by pneumatic atomization itself.

According to another variant of the device of the invention, the spray tunnel is vertical; this arrangement may be advantageous for the pickling of wire or of metal tube.

According to another variant of the invention, the device is suitable for pickling coils or reels of wire. It comprises a spray chamber equipped with a support for the coil, means for spraying a pickling solution onto the coil in the said chamber, means for monitoring, means for recirculating, means for treating and means for maintaining the temperature of the said solution.

Figure 3:
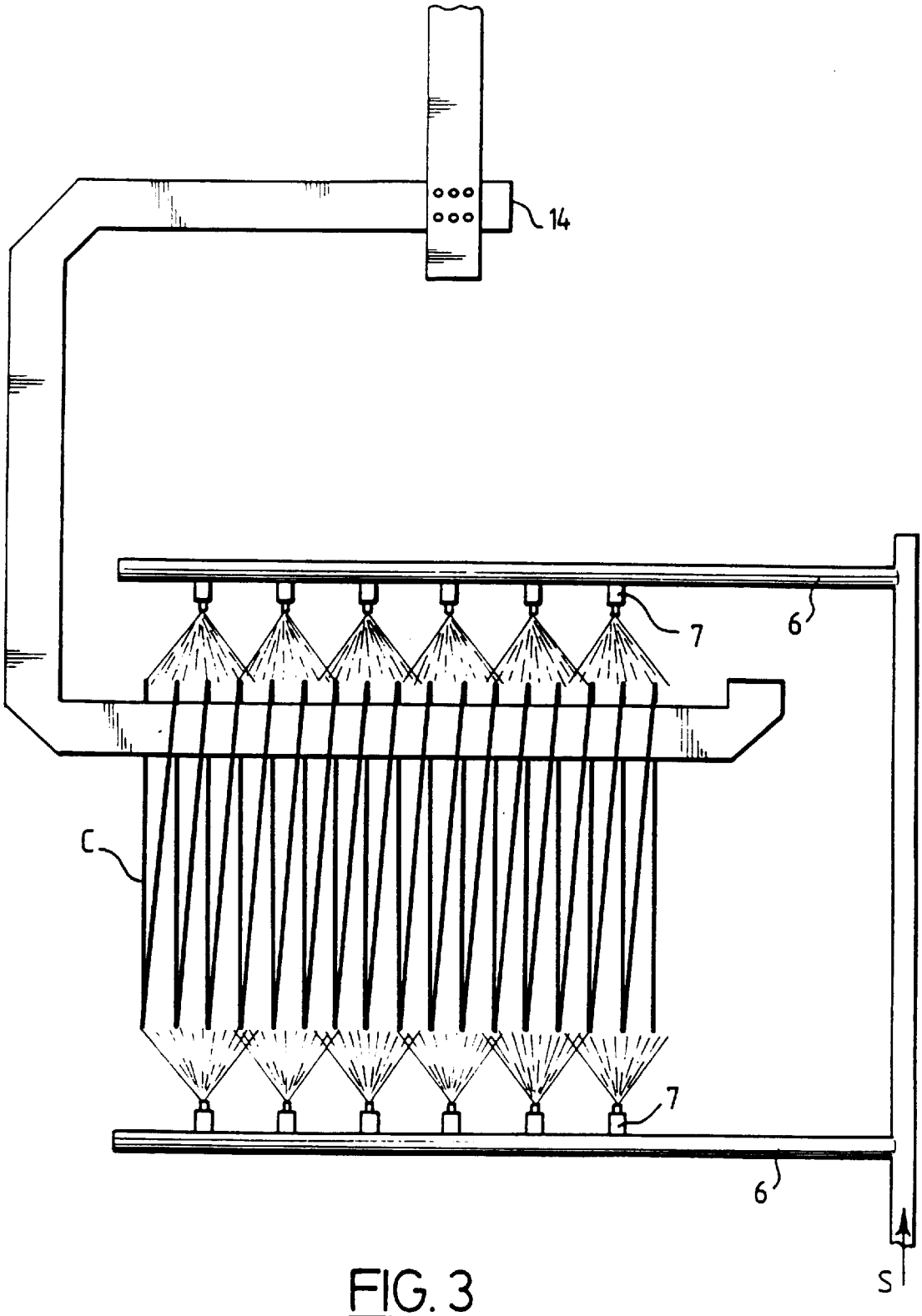
FIG. 3 is a side view of a device for spraying coils of wire, forming part of a pickling device according to the invention.

FIG. 3 depicts a detail of such a device and illustrates the spraying of a coil of wire.

The device comprises a support 14 in the form of a hook which supports, on its lower part, a coil of wire C.

The spraying means comprise two spray bars 6 arranged above and below the coil of wire C and equipped with spray nozzles 7, similar to the nozzles 7 depicted in FIG. 2 and supplied with pickling solution S via a pipe connected to the circuit for recirculating the said solution.

The spray bars 6 are arranged horizontally in the chamber, one above the other, the nozzles 7 of the upper spray bar facing the nozzles 7 of the lower spray bar. They are sufficiently far apart for the coil C carried by the support 14 to be able to be inserted into the intermediate space.

The power and orientation of the jets produced by the nozzles 7 are such that the entire coil is brought into contact with the pickling solution.

This spray device may be integrated in a batch pickling device for coils of wire, the support 14 being fixed with respect to the closed and ventilated pickling chamber. It may also be integrated in a continuous pickling device for coils of wire, which comprises several pairs of spray bars 6 defining a horizontal space through which moving supports 14 carrying coils C pass and in which a pickling solution S is sprayed onto the succession of coils C.

The following examples illustrate the invention.

Comparative Example 1

A steel plate is pickled by immersing it in a pickling bath containing ferric ions and hydrofluoric acid.

A 20 mm×50 mm rectangular plate of AISI 430 grade steel is used.

Approximately 1 l of an aqueous pickling solution containing 30 grams per liter of hydrofluoric acid (expressed as HF), 30 grams per liter of total iron in solution and having a redox potential of 250 mV with respect to a saturated calomel reference electrode, measured at 60° C., is prepared.

This solution is placed in a pickling tank equipped with a probe for measuring the redox potential and with means for bubbling air into the bottom of the tank in order to stir the solution in the tank.

The said plate is pickled by immersing it in the tank and air is bubbled through it at a flow rate of between 10 and 20 l/minute. During pickling, the temperature of the bath is maintained between 50 and 60° C. and the pH is maintained at its initial value by adding hydrofluoric acid.

Measurements are made of the initial weight change of the steel plate every thirty seconds for two minutes, and then of the average weight change after four hours, and of the change in redox potential of the solution as a function of time over four hours, this change being indicative of the ageing of the solution.

The following results are obtained:

initial weight change: 30 $g/m^2/min$;

average change in 4 h: 3.5 $g/m^2/min$;

change in the redox potential: a reduction of more than 100 mV in 4 hours.

Were it to be desirable to increase the life of such a solution further, it would be necessary to supplement the air bubbling with the addition of small amounts of oxidizing agents, for example hydrogen peroxide.

EXAMPLE 1

The same 20 mm×50 mm rectangular plate of AISI 430 grade steel is pickled using a spray device.

Approximately 2 l of the same pickling solution as in Comparative Example 1 are prepared.

The spraying device takes the form of a spray tunnel and comprises a chamber provided with a cover and a tank filled with the pickling solution S and equipped with a probe for measuring the redox potential.

Installed in this chamber is a sprinkling nozzle fed with the spray solution by a pump whose inlet pipe dips into the said tank.

The plate to be pickled is placed horizontally above the tank, approximately 30 cm below the sprinkling nozzle.

A ventilator continuously aerates the spray chamber.

The pickling solution S is sprayed uniformly over the entire surface of the plate; the spent solution is collected by the tank under the plate; the pump extracts the collected solution and sends it back to the sprinkling nozzle. The temperature of the solution is maintained between 50 and 60° C. and the pH is maintained at its initial value by adding hydrofluoric acid.

As in the case of Comparative Example 1, the initial weight change of the steel plate is measured every thirty seconds for two minutes, and then the average weight change at the end of four hours and the change in the redox potential of the solution as a function of time over four hours are measured.

The following results are obtained:

initial weight change: 50 g/m$^2$/min;

average change in 4 h: 8.7 g/m$^2$/min;

change in the redox potential: reduction of less than 80 mV in 4 hours.

Compared to Comparative Example 1, the solution S has a much longer life without adding an oxidizing agent more oxidizing than air, such as hydrogen peroxide.

Furthermore, by virtue of this spraying process, on the one hand an improvement in the pickling rate is obtained during the initial period of use of the pickling solution (in this case: 2 minutes) and, on the other hand, this improvement in the pickling rate remains significant even after 4 hours.

Compared to the immersion pickling in Comparative Example 1, the overall pickling kinetics are multiplied by approximately a factor of 2.5.

Comparative Example 2

The conditions for this test are identical to those in Comparative Example 1, except that the plate is pickled for 3 hours, keeping the redox potential of the pickling solution constant and at its initial value; to do this, a hydrogen peroxide solution containing 30% by weight of $H_2O_2$ is added regularly to the pickling solution.

At the end of 3 hours, the total volume $V_0$ of hydrogen peroxide added to the pickling solution, in order to keep its redox potential constant, is measured; the weight change of the steel plate is also measured.

The average weight change in 3 hours is 10 g/m$^2$/min.

EXAMPLE 2

The conditions for this test are identical to those in Comparative Example 2, except that the plate is pickled for 3 hours, keeping the redox potential of the pickling solution constant and at its initial value; to do this, a hydrogen peroxide solution containing 30% by weight of $H_2O_2$ is added regularly to the pickling solution.

At the end of 3 hours, the total volume V of hydrogen peroxide added to the pickling solution, in order to keep its redox potential constant, is measured; the weight change of the steel plate is also measured.

The average weight change in 3 hours is 14 g/m$^2$/min.

In order to assess the difference in efficacy of the processes in Comparative Example 2 and Example 2, the volumes $V_0$, V of hydrogen peroxide added are expressed relative to the amounts of steel pickled, in order to calculate the saving in hydrogen peroxide, which in this case amounts to 54%.

Thus, in the case in which an oxidizing agent such as hydrogen peroxide is used, the oxygen-jet process of the invention remains economical since it makes it possible to decrease by half the amount of this expensive reagent for achieving the same efficacy.

Comparative Example 3

In this example, a 20 mm×50 mm rectangular plate of AISI 304 grade steel is pickled by immersion under identical conditions to those in Comparative Example 1. The following results are obtained:

initial weight change: 27 g/m$^2$/min;

average change in 4 h: 0.5 g/m$^2$/min.

EXAMPLE 3

In this example, the same plate is pickled by spraying, under identical conditions to those in Example 1. The following results are obtained:

initial weight change: 33 g/m$^2$/min;

average change in 4 h: 1 g/m$^2$/min.

Compared to the immersion pickling in Comparative Example 3, the average pickling kinetics over several hours are multiplied by 2 in the process of Example 3.

EXAMPLE 4

The pickling solution used in the above examples may be used for the continuous pickling, in a spray tunnel, of a strip of AISI 304 grade steel.

The spray tunnel has a total volume of 50 m$^3$. It is equipped at one of its ends with a ventilator, connected to an air intake, blowing air into the tunnel with a flow rate of 3.5 m$^3$/minute.

The steel strip, having a width of 1.3 m, runs through the tunnel at a speed of 25 m/min.

The spray bars, of a standard type, are equipped with spray nozzles spaced 30 cm apart.

The pickling solution pumped into the collecting tank of the tunnel feeds the spray bars at a pressure of $3\times10^5$ Pa for a flow rate of 2 m$^3$/min.

A heater keeps the temperature of the pickling solution between 50 and 60° C.

This pickling device was able to be operated for periods of several weeks, maintaining a satisfactory redox potential with good pickling quality.

EXAMPLE 5

An aqueous pickling solution containing 60 g/l of hydrofluoric acid (expressed as HF), 70 g/l of total iron in solution and having a redox potential of 220 mV with respect to a saturated calomel reference electrode, measured at 75° C., is prepared.

This solution is used for the continuous pickling of cold-rolled AISI 304 grade stainless steel strip in a spray tunnel having a volume of approximately 31 m$^3$.

This tunnel is equipped with three ports connected to an air intake device and the flow rate of air drawn in is 160 m$^3$/min; the three ports are arranged at regular intervals along one of the side walls of the chamber, parallel to the path along which the strip runs.

The tunnel, is equipped with 32 spray bars arranged approximately 25 cm above and below the running strip and distributed at regular intervals along the tunnel; each spray bar is equipped with spray nozzles uniformly spaced apart by 35 cm.

The spray bars are fed with pickling solution at a pressure of $3\times10^5$ Pa (3 bar) and deliver in total 2 $m^3$/min of solution.

A heater makes it possible to maintain the pickling solution at approximately 75° C. The redox potential of the solution is maintained at 220 mV by regularly adding hydrogen peroxide. The steel strip, having a width of 1.24 m runs through the tunnel at a speed of 48 m/min.

The results obtained with this plant were compared with those of an immersion pickling plant having the same length with the same solution maintained at the same temperature and at the same redox potential, using hydrogen peroxide, and applied to the same steel strip running at a slower speed of 42 m/min.

It is observed that, by virtue of the invention, 15% less hydrogen peroxide is consumed for a 15% greater run speed.

There is therefore a 15% gain in pickling efficacy and a 30% saving in the amount of hydrogen peroxide used for pickling a given length of sheet.

We claim:

1. A process for pickling a metallic material, comprising:

spraying onto said metallic material a pickling solution; and recovering and recycling said pickling solution;

wherein said spraying, recovering and recycling are carried out in a closed pickling-solution circuit, said spraying is carried out in a confined atmosphere in a spray chamber with an influx of oxygen by introducing an oxygen-containing gas into the chamber, and said pickling solution comprises ferric ions and at least one acid selected from the group consisting of a haloacid, an inorganic acid and, an organic acid which is not an iron-oxidizing agent, wherein said metallic material is an alloy steel, stainless steel or titanium alloy.

2. Process according to claim 1, in which the flow of the oxygen-containing gas in the spray chamber is sustained.

3. Process according to claim 1, in which the oxygen content of the oxygen-containing gas is greater than 10%.

4. Process according to claim 1, in which the flow rate of the oxygen-containing gas is at least equal to the spray flow rate of the solution.

5. Process according to claim 1, in which the flow of the oxygen-containing gas makes it possible to replenish the atmosphere in the spray chamber on average at least every 15 minutes.

6. Process according to claim 1, in which the oxygen content of the atmosphere is maintained above 10%.

7. Process according to claim 1, in which the ratio between the spray flow rate of the solution, expressed in liters per minute, and the surface area to be pickled per unit time, expressed in square meters per minute, is at least equal to five.

8. Process according to claim 1, in which at least part of the pickling solution is introduced into the chamber by atomization.

9. Process according to claim 1, in which the redox potential of the pickling solution is maintained at a predetermined value.

10. Process according to claim 9, in which the redox potential is set to the predetermined value by adjusting the flow rate of the introduction of the oxygen-containing gas.

11. Process according to claim 9, in which the redox potential is set to the predetermined value by adding an oxidizing agent to the pickling solution.

12. Process according to claim 9, in which the redox potential is set to the predetermined value by adjusting the spray flow rate of the solution.

13. Process according to claim 1, in which a stream of hot oxygen-containing air is blown into the pickling solution.

* * * * *